United States Patent [19]

Lee et al.

[11] Patent Number: 4,907,807

[45] Date of Patent: Mar. 13, 1990

[54] BOARD GAME FOR PLAYING CROSSWORD PUZZLES

[76] Inventors: Donald V. Lee; Julius C. Ermis, both of 1718 P Street, N.W. - #402, Washington, D.C. 20036

[21] Appl. No.: 295,539

[22] Filed: Jan. 11, 1989

[51] Int. Cl.[4] ..... A63F 3/00

[52] U.S. Cl. ..... 273/240; 273/272; 273/243

[58] Field of Search ..... 273/272, 240, 243

[56] References Cited

U.S. PATENT DOCUMENTS 4,306,724 12/1981 Brzezinski et al. ..... 273/272
4,557,485 12/1985 Lardon ..... 273/249

FOREIGN PATENT DOCUMENTS

PCT/GB87/-
00469 1/1988 United Kingdom ..... 273/272

*Primary Examiner*—Edward M. Coven
*Assistant Examiner*—Benjamin Layno
*Attorney, Agent, or Firm*—Richard C. Litman

[57] ABSTRACT

A board game having a generally square game board with contiguous squares in a continuous band around its periphery, playing pieces, throwing dice and play cards providing opportunities for playing a crossword puzzle positioned on the game board. The player entering the largest number of letters, as determined by a letter count of all the words the player enters, wins the game. Individual play involves rolling two dice to determine the number of squares through which the playing piece is moved and whether the word to be played on the crossword puzzle shall be across or down. Once on a square, the player must guess a word from clues on a play card, and correctly guessing the word allows the player an attempt to add a word on the crossword puzzle thereby providing an opportunity for scoring.

15 Claims, 3 Drawing Sheets

BOARD GAME FOR PLAYING CROSSWORD PUZZLES

FIELD OF THE INVENTION

The present invention relates to board games having a square game board with contiguous squares around its periphery and more specifically to a game with dice, playing pieces and play cards, the playing of which allows winners to make entries in a crossword puzzle.

BACKGROUND OF THE INVENTION

Crossword puzzles are primarily intended as play for a single person, pitting the player's vocabulary skills against a prearranged list of word clues, the answers to which are written in vertical columns or horizontal rows of empty squares connected by black squares to form a matrix.

While the entertainment and educational value of the game is universally acknowledged, the crossword puzzle is not intended to be played by more than one player, offering little entertainment value as a group activity.

For this reason, games based on solving crossword puzzles but adapted for group play, have generally been commercially successful, the game of "Scrabble" by Selchow and Righter being the best known example. U.S. Pat. Nos. 4,106,773 and 4,179,126 issued to Coefield are typical. Here, a crossword puzzle is shared by two persons, using colored pencils to write the letters into the puzzle, each player having a pencil of different color to simplify scorekeeping. U.S. Pat. No. 4,205,852 issued to Wayman discloses a system and game apparatus for creating crossword puzzles which can be played by several players.

These patents or known prior uses teach and disclose various types of crossword puzzle games of various sorts and various manufactures, and the like, as well as methods of their construction; but none of them, whether taken singly or in combination, disclose the specific details of the combination of the invention in such a way as to bear upon the claims of the present invention.

OBJECTS OF THE INVENTION

Accordingly, one of the objects of the present invention is to provide a board game which includes a conventional crossword puzzle, whereby several players can play the puzzle in turn and in competition.

A further object is to provide a board game which is played in conjunction with a conventional crossword puzzle whereby players in turn must first play the board game to win opportunities to add words to the crossword puzzle, the player with the highest number of letters entered being the winner.

Another object is to provide a board game to be used in conjunction with a conventional crossword puzzle, the game having a square board, a pack of crossword puzzles, playing pieces, a pair of dice, play cards and a central square in which to place the crossword puzzle.

Still another object is to provide a game board having two continuous rows of playing squares around its outer margin, both rows being playing paths which are connected at intervals to act as paths for playing pieces from one row to another.

Another object is to provide play cards with clues of the crossword puzzle variety with blocks for the answers on the reverse side, each card having several clues of increasing difficulty, with each clue identified by a number signifying the degree of difficulty.

Another object is to provide a die for use in selecting the orientation of words to play on a crossword puzzle, the die being a cube with six facets, two facets having the indicia marks DOWN, two facets having the indicia marks ACROSS and two faces having the indicia marks OR.

And another object is to provide a pair of dice for determining the steps of each play, one die of the conventional numbered cubic type, the second die of the same size and shape except for having ACROSS, DOWN and OR indicia.

And another object is to provide a method of playing a board game in conjunction with a crossword puzzle which permits several people to play the puzzle in turn and competitively.

With these and other objects in view which will more readily appear as the nature of the invention is better understood, the present invention resides in the novel method, apparatus, combination and assembly hereinafter more fully illustrated, described and claimed, with reference being made to the accompanying drawings.

DETAILED DESCRIPTION OF THE PREFERRED EMBODIMENT

Figure 1:
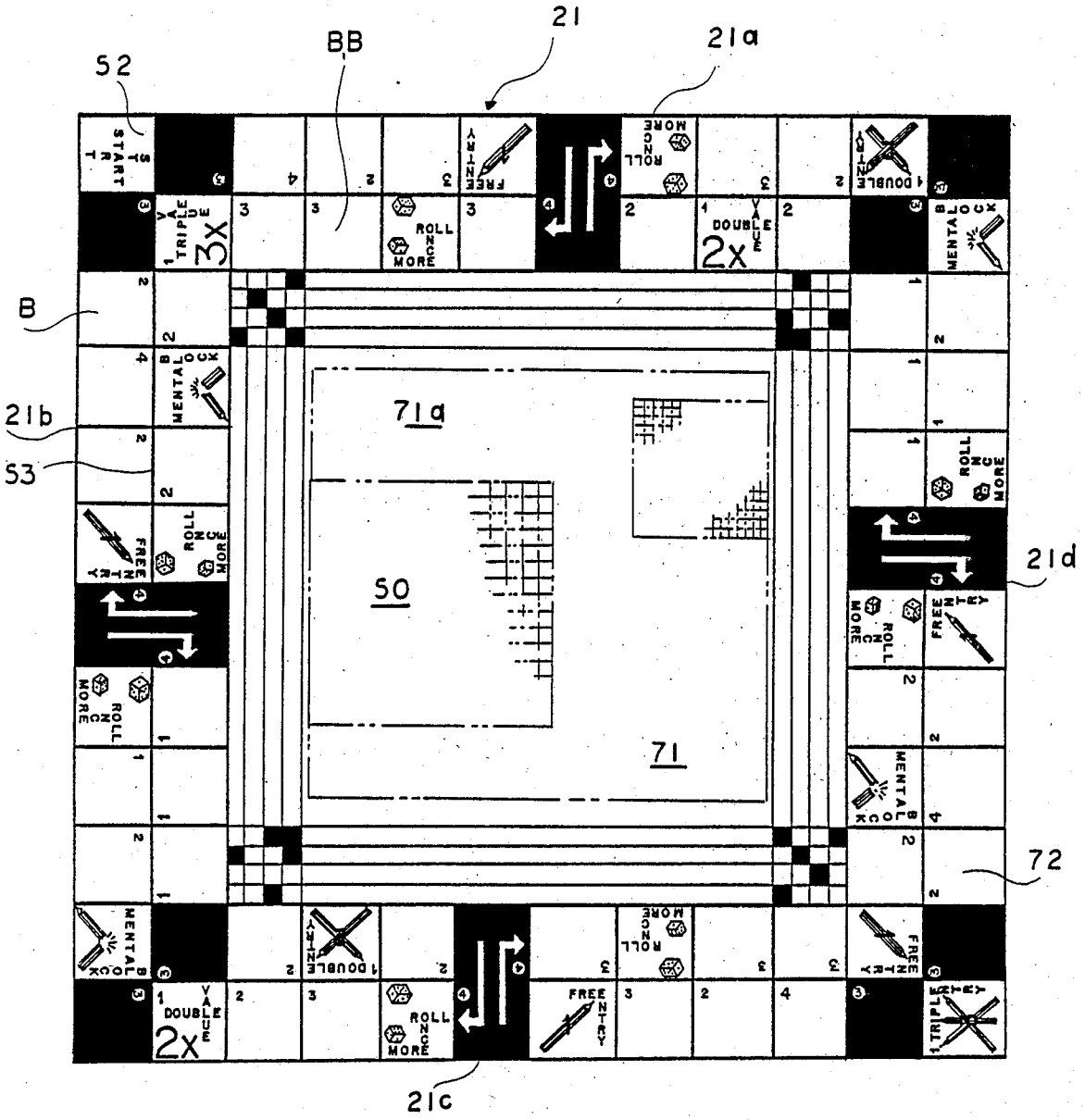
FIG. 1 is a top plan view of the game board of the invention with a crossword puzzle in place.
Figure 2:
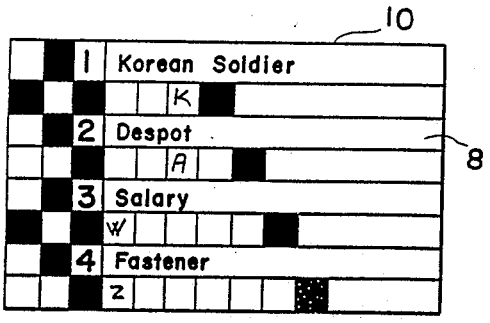
FIG. 2 is a top plan view of a first play card.
Figure 3:
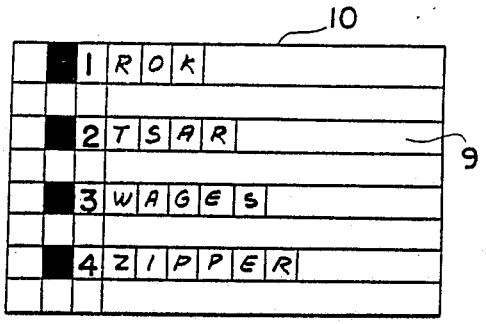
FIG. 3 is a bottom plan view of a first play card.
Figure 4:
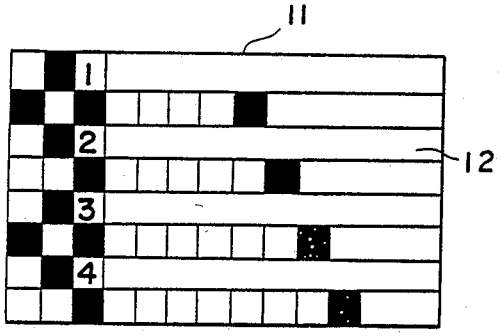
FIG. 4 is a top plan view of a second play card.
Figure 5:
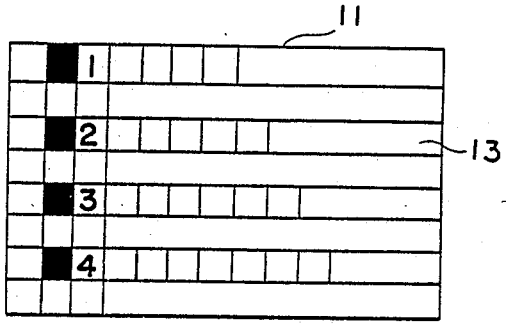
FIG. 5 is a bottom plan view of a second play card.
Figure 6:
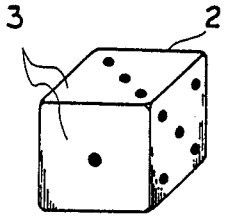
FIG. 6 is a perspective view of a number die.
Figure 7:
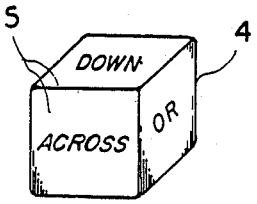
FIG. 7 is a perspective view of a direction die.
Figure 8:
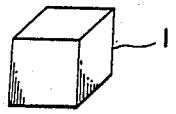
FIG. 8 is a perspective view of a game piece.

Referring now to FIGS. 1 and 8, the game comprises a game board 21, a quantity of game pieces 1 distinguished from each other by having different colors or different indicia marks for each piece, a number die 2 having six die faces 3, as shown in FIG. 6, each face 3 having a single number indicia between one and six, a direction die 4 having six die faces 5 as shown in FIG. 7, two faces having the indicia ACROSS, two faces having the indicia DOWN and two faces having the indicia OR as shown in FIGS. 2 and 3, the game of the invention. Six hundred play cards 10, each having a front clue face 8 with four word clues of increasing difficulty, the answers to which are on the cardback face 9. As can be seen, the four word clues are respectively a three-letter word, a four-letter word, a five-letter word, and a six-letter word. The words are arranged from top to bottom of the cardface, the shortest being on top. The difficulty associated with each word is also numerically identified with the number 1 adjacent the shortest word, progressing to the number 4 associated with the longest. The degree of difficulty can be altered by printing one or more of the clue word letters in advance on the play cards.

Six hundred play cards 11 are also included, each having a front clue face 12 with four word clues of increasing difficulty, the answers which are on the cardback face 13 and are respectively a four-letter word, a five-letter word, a six-letter word, and a seven-letter word. The words are arranged from top to bottom of the answer face, the shortest being on top. The degree of difficulty associated with each word is numerically identified with the number 1 adjacent the shortest word, progressing to the number 4 associated with longest.

Figure 9:
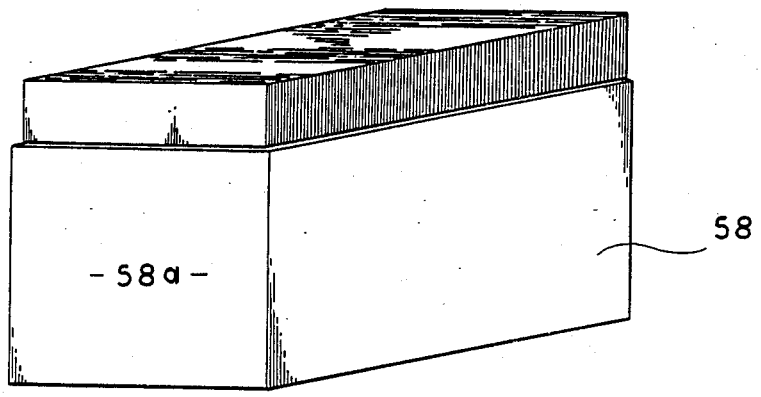
FIG. 9 is a perspective view of a cardbox incorporated with the invention.

The playing cards 10,11 are placed in two cardboxes 58, one of which is shown in FIG. 9, the height of the boxes being less than the height of the cards, so that front clue faces 8,12 of the cards are visible to the player when the cards are stacked in the boxes 58. As it is important that the cards are all facing in the same direction in the box, to prevent the back answer faces 9,13 of the cards from being exposed to the players, one end 58*a* of the box 58 is identified as the front clue face.

At the start of the game, the play cards 10,11 are shuffled together and placed in equal quantities in the two cardboxes 58 with their front clue faces 8,12 facing towards the box end 58*a*. In play, cards 10,11 are removed one at a time in sequence from each cardbox 58, used in play and returned to the opposite end of the box 58, with their front clue faces 8,12 again facing the ends 58*a* of the boxes.

The game is played on game board 21, being generally square in shape and having side edges 21*a*,21*b*,21*c*,21*d*. The board 21 is constructed of inexpensive material such as cardboard having a top playing surface 71 with a pattern of play imprinted on it. The board 21 has a first continuous band B of contiguous squares S around its margin, adjacent the board side edges 21*a*,21*b*,21*c*,21*d*. The pattern of squares S in the band B consists of a square in each corner of the board 21, each connected by a row of ten contiguous squares. The pattern also includes a second inner band BB of contiguous squares adjacent the outer band B, the squares S on the inner band BB having the same dimensions as the squares and being axially aligned with them. The inner band BB has squares in each corner connected by rows of eight contiguous squares.

The remaining area inside the board playing surface 71 comprises a crossword puzzle are 71*a* in which a crossword puzzle 50 is placed for subsequent play.

Each square contains identifying indicia and the play action to be taken and also contains a number which specifies the degree of difficulty number for the clue to be played from the play card 10,11. The play squares which are shown in FIG. 1 include:

White play squares SW having degrees of difficulty of one, two, three or four respectively.

Black play squares SB having degrees of difficulty of three or four respectively.

ROLL ONCE MORE squares

MENTAL BLOCK squares

FREE ENTRY squares

DOUBLE ENTRY squares

TRIPLE ENTRY squares

DOUBLE VALUE squares

TRIPLE VALUE squares

START square

The pattern of the squares S on the game board 21 is symmetrical. Each of the inner and outer bands B,BB has approximately the same number of each square, located in the same positions on the four sides of the game board 21.

Certain entities on the game board are colored to aid in game play or simply to enhance its appearance. The boundary line 53 between the squares in the inner and outer bands B,BB is red to more clearly mark the separation between the two bands. The shank portion of the pencil indicia in the FREE ENTRY, DOUBLE ENTRY and TRIPLE ENTRY squares is yellow. The playing pieces 1 may also be colored each differently, as means for identifying them.

The object of the game is for two or more players to compete to complete a crossword puzzle, the winner being the player who has added the most letters to the puzzle. Players gain access to the puzzle by playing a board game first, each player in turn.

Play begins by seating the players around the game board 21 and placing the two filled cardboxes 58 to the side of the board, accessible to the players. Each player places his playing piece 1 in the start square 52. Each player rolls die 2 once, the player with the highest number starting the game. Ties are broken by having the tied players each roll die 2 again, the player with the highest number being the winner.

The starting player proceeds by throwing both dice 2, 6 once. The number on die 2 is the number of squares he must move his game piece from the square he is currently occupying, which is the START square 52 initially. The game piece 1 is moved in the clockwise direction on the outer band B.

Play squares S allow the player to take the next step, which is to attempt to solve a single-word puzzle after the style of a crossword puzzle, as contained on the play cards 10,11. Referring to FIG. 1, the various play squares require these play actions:

Play squares having indicia marks 1, 2, 3, 4 respectively require the player to read the clue and correctly identify the missing word on a single play card 10,11.

Each card contains four clues and four answers, identified by the difficulty indicia corresponding to the indicia marks in the corners of the play squares S.

The player must answer the clue having the degree of difficulty corresponding to the indicia in the corner of the square S.

If the player is unsuccessful in answering the clue, he relinquishes his turn to the player on his left, his playing piece remaining in place until his turn comes around again.

If the player successfully furnishes the correct answer to the clue, he now must select a word on the crossword puzzle 50 in the across or down direction as determined by his roll of direction die 4. The word is entered by the player on the puzzle, the player scoring points—one point for each letter in the word.

The word selected and its score are recorded by the scorekeeper under the player's name and play passes to the next player.

DOUBLE VALUE squares are played the same as play squares except that any score from playing the crossword puzzle is doubled.

TRIPLE VALUE squares are played the same as play squares except that any score from playing the crossword puzzle is tripled.

FREE ENTRY squares give the player an entry to the crossword puzzle 50 without answering a question from a play card 10,11. The rules of play are otherwise the same as for a play square.

DOUBLE ENTRY squares give the player up to two entries to the crossword puzzle 50 after answering a question from a play card 10,11. The player must correctly complete one or two words in order to receive word score. If only one word can be completed, it is added to the player's word score and play passes.

TRIPLE ENTRY squares give the player up to three entries to the crossword puzzle 50 after answering a question from a play card 10,11. The player must correctly complete up to three words in order to receive word score. If only one word can be completed, it is added to the player's word score and play passes.

Black squares SB do not permit an entry in the crossword puzzle 50. However, the player must answer the clue on a play card of difficulty level of the indicia in the square.

Black squares SB are crossovers from the outer band B to the inner band BB of squares, wherein the direction of play becomes counterclockwise. When a player lands on a black square SB, his next turn requires him to move inward to the next black square and then to the next square in a counterclockwise direction. The player continues to play in the inner band BB until he again lands on a black square SB, which requires him to move to the outer band B and resume playing in the clockwise direction. In other respects, the rules of play are the same as the black square SB.

The START square 52, at the intersection of side edges 21*a*, 21*b*, is where all game pieces 1 are placed when starting the game. Play action for this square is the same as for a play square 24.

ROLL ONCE MORE squares do not allow any play action. Players simply roll the dice and move again.

The game ends when all squares in the crossword puzzle are filled in, or when all players agree to stop. The winner is the player who has scored the highest number of points.

Incorrect words entered into the crossword puzzle are erased, and the player who entered them is penalized by having twice the word score for the particular word subtracted from his game score. Only the erroneous word is erased. Other words entered as part of a double or triple entry remain and their score is not subtracted from the player's game scores.

Variations in play are possible. A timer may be used to limit the time for each play or individual players may have their time limited to speed up play. Also, players may play in teams, each team having one player piece. Players may also agree to use a dictionary throughout the course of the game.

As a result of the applicant's disclosure herein, those having skill in the art to which the present invention pertains will now perceive a method of playing the game and employing the disclosed apparatus along with any modifications and additions which may be made thereto. By way of example, the apparatus may be constructed of numerous materials and in various colors. Accordingly, all such modifications and additions are deemed to be within the scope of the invention, which is to be limited only by the claims appended hereto.

I claim:

1. A game apparatus comprising:

a playing board including a first continuous playing path of contiguous squares adjacent the outer edges of said board, a second continuous playing path of contiguous squares adjacent said path, groups of said squares having indicia which relate to subsequent play;

a plurality of playing pieces for delineating individual players;

chance means for determining the movement of said playing pieces in turn a number of spaces along said paths;

a plurality of play cards having indicia thereon relating to word clues for ascertaining single words and said words indicated by said clues;

a crossword puzzle of a conventional type for association with said playing board for play by a respective player upon the player successfully ascertaining said single words and chance means for indicating crossword puzzle play.

2. The game apparatus of claim 1, wherein:

said squares in said first playing path include a square for indicating the start of the game.

3. The game apparatus of claim 2, wherein:

said squares in said paths are provided with indicia for authorizing a draw of one of said play cards and for designating a level of difficulty of said clues.

4. The game apparatus of claim 3, wherein:

said indicia on said squares in said paths include indicia for designating a quantity of no less than two crossword puzzle clues that may be played if said word clue of said play card is answered.

5. The game apparatus of claim 2, wherein:

the indicia on at least some of said squares include terms which permit the crossword puzzle score won in a single turn to be multiplied by a selected amount.

6. The game apparatus of claim 2, wherein:

the indicia on a least some of said squares include terms which permit access to said crossword puzzle for playing a single-word clue without authorization of a play card draw.

7. The game apparatus of claim 2, wherein:

the indicia on at least some of said squares include terms which permit the playing of a clue from said card but deny access to said crossword puzzle.

8. The game apparatus of claim 2, wherein:

the indicia on at least some of said squares include terms which further require a lateral move between said first and second paths and a reversal of the direction of travel of said playing pieces on one of said paths.

9. The game apparatus of claim 2, wherein:

the indicia on at least some of said squares include terms prohibiting play, require another play and a move to another square.

10. The game apparatus of claim 2, wherein:

the indicia on at least some of said squares include terms which prohibit play and end the player's turn.

11. The game apparatus of claim 1, wherein:

said playing board includes a central area for receiving said crossword puzzle.

12. The game apparatus of claim 1, wherein:

said chance means include a pair of dice of cubic shape each having six flat facets, each of said facets having indicia relating to the play of the game;

said pair of dice includes a first die, said facets on said first die having dot indicia representing the numerical values from 1 to 6; and said pair of dice includes a second die, said facets on said second die having indicia for limiting the choice of words which may be placed in said crossword puzzle.

13. The game apparatus of claim 12, wherein two of said facets on said second die include the indicia ACROSS and two of said facets include the indicia DOWN and two of said facets include the indicia OR.

14. The game apparatus of claim 1 wherein said plurality of play cards are provided with indicia relating to the solving of a crossword puzzle and clues for solving no less than two words and wherein said squares in said playing paths are provided with numerical indicia for indicating word clues on each of said cards, said word clues being on one side of each of said cards and the answers to said word clues on the other side of each of said cards.

15. The game apparatus of claim 1 wherein a timer is included for limiting play time for said players.

* * * * *